US007527009B2

(12) United States Patent
Groβ et al.

(10) Patent No.: US 7,527,009 B2
(45) Date of Patent: May 5, 2009

(54) METHOD FOR DAMPING OF THE ROLLING MOTION OF A WATER VEHICLE, IN PARTICULAR FOR ROLL STABILIZATION OF SHIPS

(75) Inventors: Harald Groβ, Bolheim (DE); Dirk Jürgens, Heidenheim (DE)

(73) Assignee: Voith Turbo Marine GmbH & Co. KG, Heidenheim (DE)

( * ) Notice: Subject to any disclaimer, the term of this patent is extended or adjusted under 35 U.S.C. 154(b) by 113 days.

(21) Appl. No.: 11/563,319

(22) Filed: Nov. 27, 2006

(65) Prior Publication Data

US 2007/0123120 A1 May 31, 2007

(30) Foreign Application Priority Data

Nov. 26, 2005 (DE) ..... 10 2005 056 469

(51) Int. Cl.
*B63B 39/08* (2006.01)

(52) U.S. Cl. ..... 114/122; 114/126; 440/93; 701/21

(58) Field of Classification Search ..... 440/93; 114/121, 122, 126; 701/21
See application file for complete search history.

(56) References Cited

U.S. PATENT DOCUMENTS

| | | | | |
|---|---|---|---|---|
| 2,155,456 | A | 4/1939 | Von Den Steinen | |
| 2,155,892 | A | 4/1939 | Von Den Steinen | |
| 3,665,168 | A * | 5/1972 | Canfield | 701/21 |
| 4,752,258 | A * | 6/1988 | Hochleitner et al. | 440/93 |

* cited by examiner

*Primary Examiner*—Sherman Basinger
(74) *Attorney, Agent, or Firm*—Baker & Daniels LLP

(57) ABSTRACT

A method for damping of the rolling motion of a water vehicle, in particular roll stabilization of a ship with at least one propeller, comprising a rotating wheel body, which bears axis parallel blades on the outer circumference, the blades being pivoted around their longitudinal axis. The rolling motion of the water vehicle by modification of the pitch a thrust is generated which counteracts the rolling motion. The modification of the pitch for generation of a counterthrust takes place optionally in the recording of a quantity characterizing the rolling motion of the ship or a signal for activation of the roll stabilization in dependency on a default value of the current transverse pitch set on the blades.

19 Claims, 5 Drawing Sheets

Figure 1:
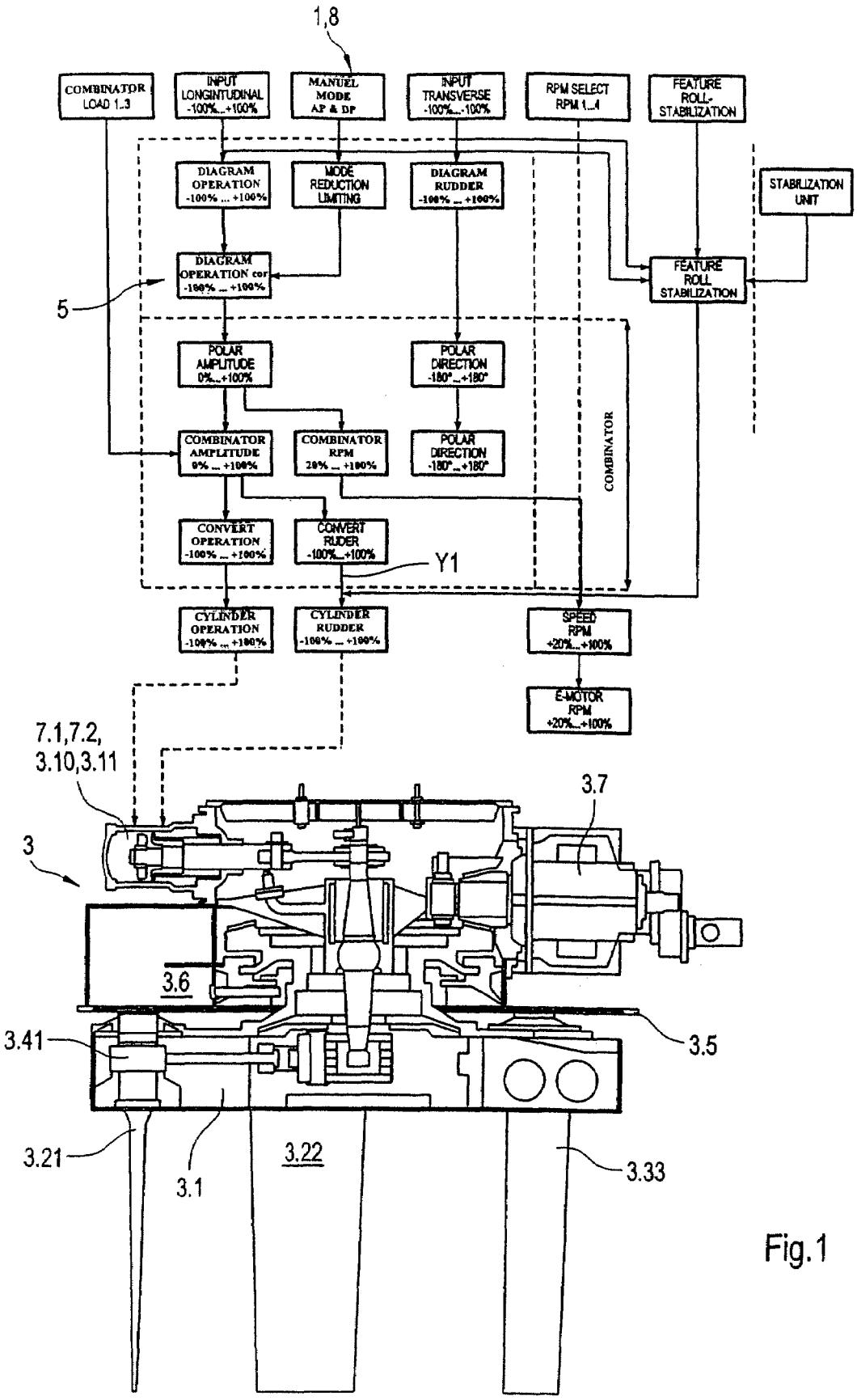

METHOD FOR DAMPING OF THE ROLLING MOTION OF A WATER VEHICLE, IN PARTICULAR FOR ROLL STABILIZATION OF SHIPS

The invention relates to a method for damping of the rolling motion of a water vehicle, in particular for roll stabilization of ships, in particular with the features from the generic term of claim 1.

Water vehicles, in particular ships, are exposed to the change of the environmental conditions in their range of application. Thus heavier swell causes a rolling motion of the ship perceived as uncomfortable, depending on the alignment of the waves against the hull, in particular the longitudinal axis. In the process rolling motions take place both in longitudinal direction of the ship as well as also perpendicular to said ship or in superimposed form from rolling motions in longitudinal and perpendicular direction at an angle to the longitudinal direction. In order to compensate or suppress said movements designs are known from the state of the art which use a so-called cutter propeller for roll stabilization. In the case of this design it is a matter of a propeller which comprises a rotating wheel body which bears a plurality, preferably four or five axis parallel blades in the region of its outer circumference. The blades are characterized by bearing axes arranged parallel to the axis of rotation, wherein said bearing axes additionally pivot around their own bearing axes. The blade shafts are supported in plain bearings or special rolling bearings and preferably sealed from sea water intake and oil seepage by double-action sealing rings. The wheel body is guided in axial direction by a guide plate and is centered in radial direction by a bearing, preferably a roller bearing. The guide plate absorbs the dead weight of the rotating parts and the tilting forces and torques resulting from the propeller thrust, while the bearing arrangement transfers the propeller thrust over the propeller housing to the ship. The propulsion of the wheel body takes place by means of a transmission gear flange mounted on the propeller housing and a bevel gear with cyclo-palloid gear-tooth system preferably arranged in the propeller. The ring gear is connected to the wheel body via the guard plate and the driving drum. The control of the kinematics takes place via a control stick which is operated by two pressure oil servomotors offset by 90°—a first servomotor and a second servomotor. The first servomotor functions in the process as a so-called drive servomotor and adjusts the pitch for the axial thrust, i.e. forward and return travel of the ship. The second servomotor serves the purpose of setting the perpendicular thrust, i.e. causes a movement to port-side and starboard, i.e. perpendicular to the longitudinal direction of the hull. With regard to the concrete design of this propeller a plurality of possibilities exists in detail. What is deciding is the fact that these can generate a thrust in the respective desired direction by adjustment of their blades in order to counteract a rolling motion. The use of such propellers for damping of rolling motion is anticipated for example from the following publications:

1. U.S. Pat. No. 2,155,892
2. U.S. Pat. No. 2,155,456

From the publication U.S. Pat. No. 2,155,892 the use of a cutter propeller for roll stabilization is anticipated, in which the blade adjustment for variation of the thrust in the respective desired direction is varied. This publication describes different arrangement possibilities for such a propeller. In accordance with a first embodiment a corresponding propeller is fastened underneath the center of gravity of the ship on the hull, in accordance with a second embodiment the connection takes place on the hull in horizontal direction offset to the center of gravity of the ship by less than one quarter of the length of the ship. The change of the blade position takes place in the process in particular via the activation of the servomotors in the case of the presence of a rolling motion. For this purpose a corresponding device for recording of a quantity at least indirectly characterizing the rolling motion of the ship is provided, in the simplest case in the form of a pendulum, wherein in the case of a swing of the pendulum indicating a rolling motion this swing motion is directly converted directly into a signal for activation of the individual servomotors. In the process the publication U.S. Pat. No. 2,155,892 relates mainly to the presence of a rolling motion perpendicular to the longitudinal direction of the ship, while from the publication U.S. Pat. No. 2,155,456 the use of a propeller of the initially named type is employed for roll stabilization in longitudinal direction. In the latter case, however the propeller itself is swiveled around a horizontal axis, which with regard to constructive design is very expensive and accordingly with regard to detectability permits only unsatisfactory results. On the basis of the direct coupling generally present between the device for recording of at least one quantity at least indirectly characterizing the rolling motion in the form of a mechanical recording device, in particular in the form of a pendulum, which responds directly to the rolling motion and said motion consequently simulated by adjustment, a time delay can already be observed with regard to the presence of the ACTUAL value of a quantity at least indirectly characterizing the rolling motion, as a result of which the detectability of such a system can in no way satisfy today's comfort requirements. This also applies for the conversion or allocation of the quantity at least indirectly characterizing the rolling motion to the adjustment signal, which on the basis of the coupling with the recording device is very expensive.

The invention is thus based on the object of further developing a method for damping of rolling motions of water vehicles, in particular for roll stabilization of ships in such a way that the named disadvantages are avoided, in particular since the system through the use in ships enables a high driving comfort, which expresses itself in the fact that rolling motion is severely reduced, wherein the system should be characterized by a very short response time and a low design as well as control technology expenditure.

The solution according to the invention is characterized by the features of claim 1. Advantageous designs are described in the dependent claims.

The following terms are defined for the following terms:

Longitudinal pitch corresponds to the pitch which the thrust in longitudinal direction of the ship or propulsive direction generates, wherein by pitch the pitch of the blades is understood Transverse pitch corresponds to the pitch which a thrust motion enables in transverse direction when the ship is standing and is also referred to as rudder pitch Longitudinal direction direction in or parallel to longitudinal axis of the ship (corresponds to the direction for straight ahead driving)

Transverse direction port-side or starboard, perpendicular or at an angle to the longitudinal direction Actual values for longitudinal and/or transverse pitch are default values, i.e. desired values which are predefined by input in the superior system. In accordance with the invention for the damping of the rolling motion of a water vehicle, in particular for roll stabilization of ships which are headed with a propeller in the form of a cutter propeller, comprising a wheel body with pivoting axis parallel blades arranged in the region of the outer circumference which thrust in transverse direction by changing the transverse pitch in dependency on an ACTUAL value of the currently set transverse pitch, i.e. rudder pitch, changes at least indirectly characterizing quantity, in order to counteract a rolling motion. As a result a thrust is generated at an angle to the longitudinal direction or longitudinal axis of the ship. As a result it is possible in simple manner solely on the basis of the change of the blade setting, in particular of the transverse pitch of the blades of the propeller to guarantee a corresponding selectability. The setting or change of the transverse pitch in dependency on the currently set transverse pitch takes place corresponding to a pre-definable or predefined family of characteristics (DIAGRAM OPERATION; DIAGRAM RUDDER). See FIGS. 2*a* and 3*b*. Elements in parentheses appear in FIG. 1. The family of characteristics is limited by the limiting characteristics, which reproduce the maximum adjustability in the case of a specifically set transverse pitch in a so-called transverse pitch/transverse pitch change command diagram. The correcting range in the process characterizes the adjustment in both directions, i.e. both in positive as well as negative direction related to the neutral setting of a blade. The transverse pitch is in the process characterized by the angle between the longitudinal axis of a blade and the parallel lines to the longitudinal direction of the ship or to the propulsive direction (POLAR DIRECTION). Within the named family of characteristics in dependency on an already preset transverse pitch, i.e. rudder pitch (INPUT LONGITUDINAL; INPUT TRANSVERSE), each operating point between these two limiting characteristics is selectable. The selection takes place in the process preferably in dependency on the presence of a quantity at least indirectly characterizing the rolling motion of the ship. By these in the process at least one of the following named quantities is understood:

Rolling angle

Rolling angle speed

Rolling angle acceleration

In the case of possible predicting consideration also the roll acceleration of a quantity at least indirectly characterizing the swell would be conceivable such as Frequency, Amplitude As a rule for this purpose a change of the transverse pitch is always performed and hence the rolling motion is counteracted. In accordance with a particularly advantageous design the quantity of the set longitudinal pitch is additionally considered. This minimizes the possible range of adjustment in dependency on its quantity (DIAGRAM OPERATION). As a result undesired deviations and countermovement also in another direction are prevented.

In the family of characteristics for this purpose the two limiting characteristics for the maximum adjustability in the case of set transverse pitch are allocated to each longitudinal pitch, i.e. each set longitudinal pitch is characterized by its own range of adjustment for the transverse pitch. In the process the theoretically possible range of adjustment is reduced with increasing set drive pitch.

The change of the transverse pitch takes place at least in dependency on the set transverse pitch and the strength of the rolling motion, i.e. the quantity of a quantity at least indirectly characterizing the rolling motion of the ship (POLAR AMPLITUDE). From these quantities in the family of characteristics the required change of the transverse pitch is determined (COMBINATION AMPLITUDE), from which a correcting variable for activation of the regulating device, in particular of the rudder servomotor, is formed (CONVERT OPERATION; CYLINDER OPERATION).

In accordance with an additional further development provision is made to compensate the speed reduction in longitudinal direction on the basis of a change of the pitch in transverse direction through corresponding activation in propulsive direction ( MODE REDUCTION LIMITING). This can for example take place in the form of a regulation to constant speed. In this case the propulsive motion or the set speed in propulsive direction is set as DESIRED value for a speed value to be kept constant and compared with a currently determined speed during the entire phase of roll stabilization and compensated in dependency on the deviation by change of the drive pitch. This means that here a regulation to constant speed of the roll stabilization is additionally overlaid. The overlaying in the process enables a compensation of the rolling motion at simultaneously constant, i.e. unchanged cruising speed (COMBINATOR RPM).

The solution according to the invention for roll stabilization can in the process be used as a feature in a control system for activation of initially named structured propeller in a water vehicle, in particular ship. This feature can, as required in the process be either capable of being added on or be designed to be automatically added on. In accordance with an especially advantageous design this feature is always subordinate to the actual speed control system, i.e. depending on which operating mode the ship is operated, the roll stabilization can be used only as an add-on and with regard to the priority of its actuation subordinate to the actual set operating mode. The following are distinguished as drive modes:

1.) Manual pre-selection of the drive signal, i.e. of the thrust in longitudinal direction and control of the thrust in transverse direction via a compass (MANUAL MODE)

2.) Autopilot—setting pre-definable via control system of the thrust in longitudinal direction and manual control of the thrust in transverse direction via compass 3.) Dynamic positioning—keeping of a pre-defined position at sea By autopilot the electronic predefinition of a drive signal in transverse direction is understood, while change of the longitudinal pitch can still be regulated by hand. By dynamic positioning the automated control both in longitudinal and also transverse direction is understood, as this is of advantage in particular for the keeping of a predefined position of the ship at sea. In all of these drive modes the roll stabilization can be added on and the quantities for drive pitch and transverse pitch that can be set with regard to the resulting thrust in longitudinal or transverse direction must not erase the defaults from the superior drive modes.

Figure 2B:
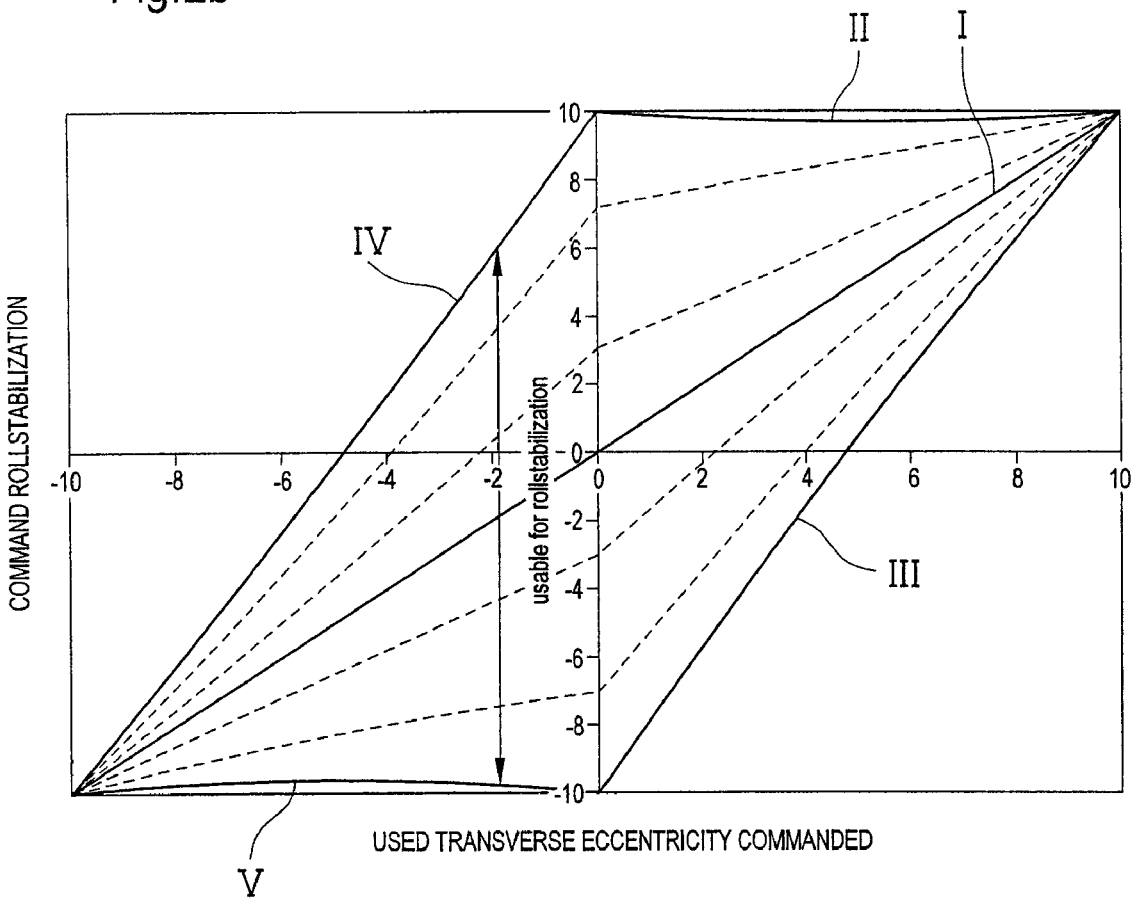
Figure 2A:
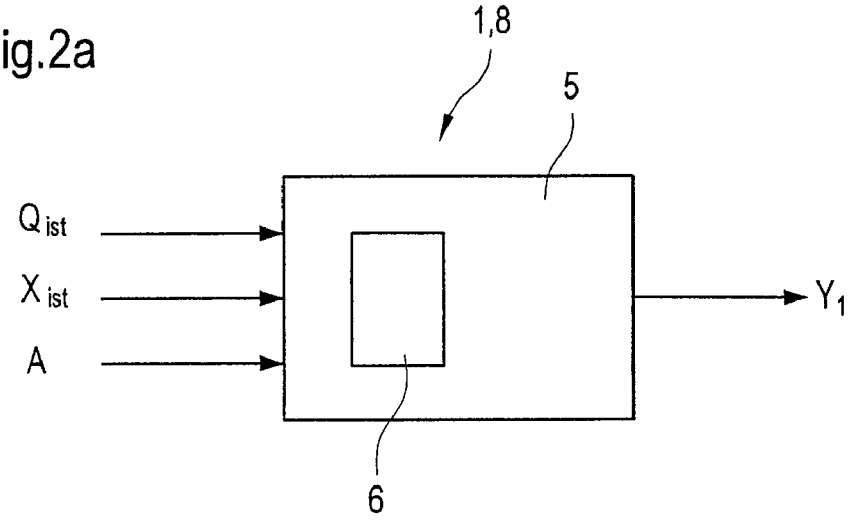
Figure 3A:
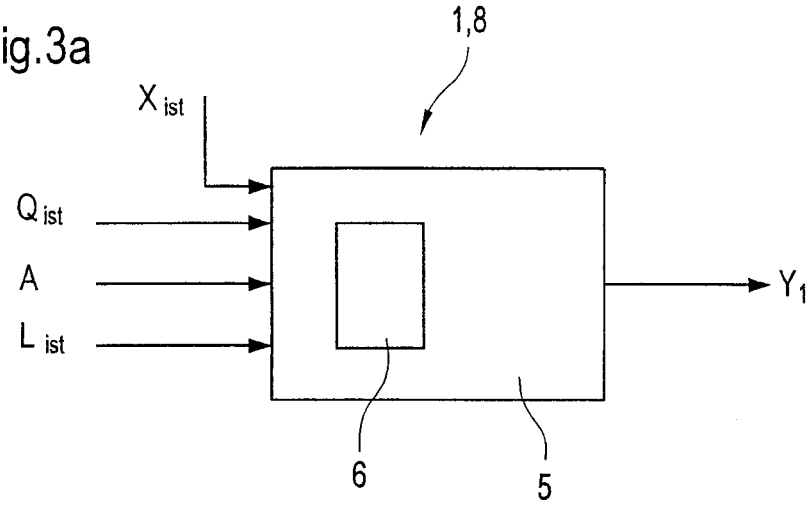
Figure 3B:
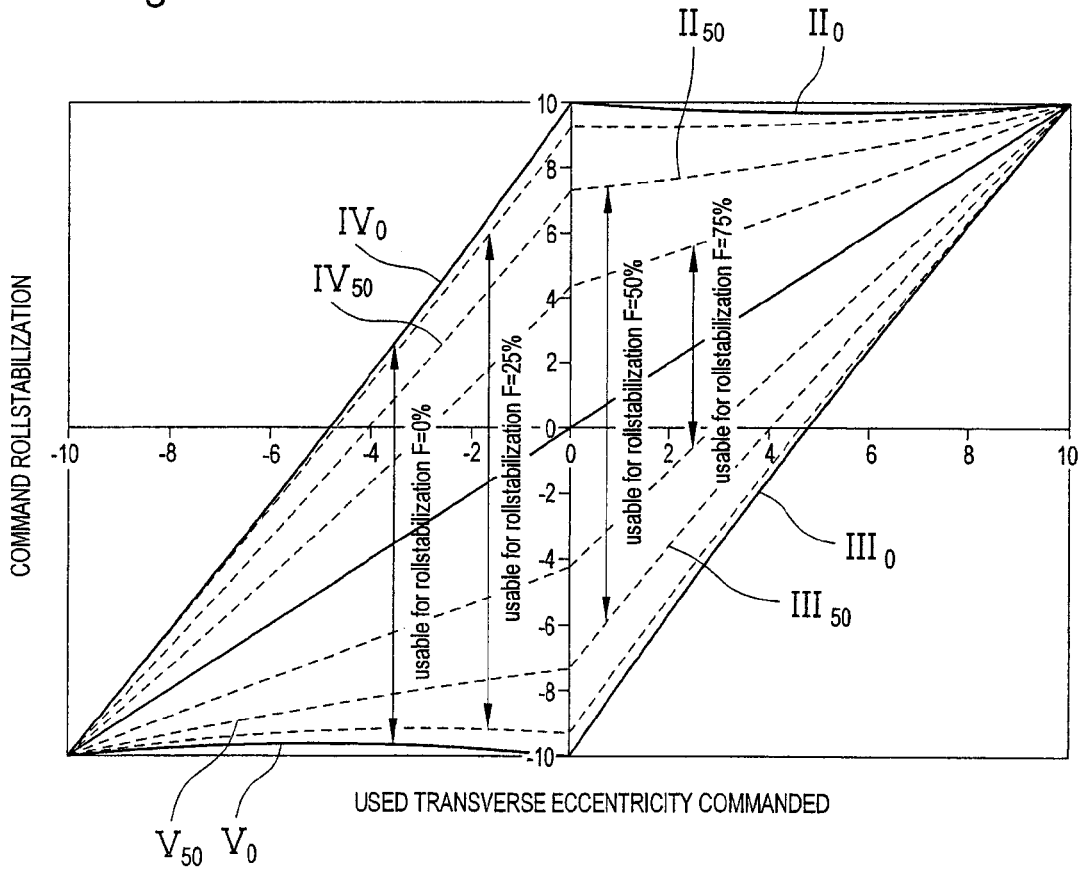
Figure 4:
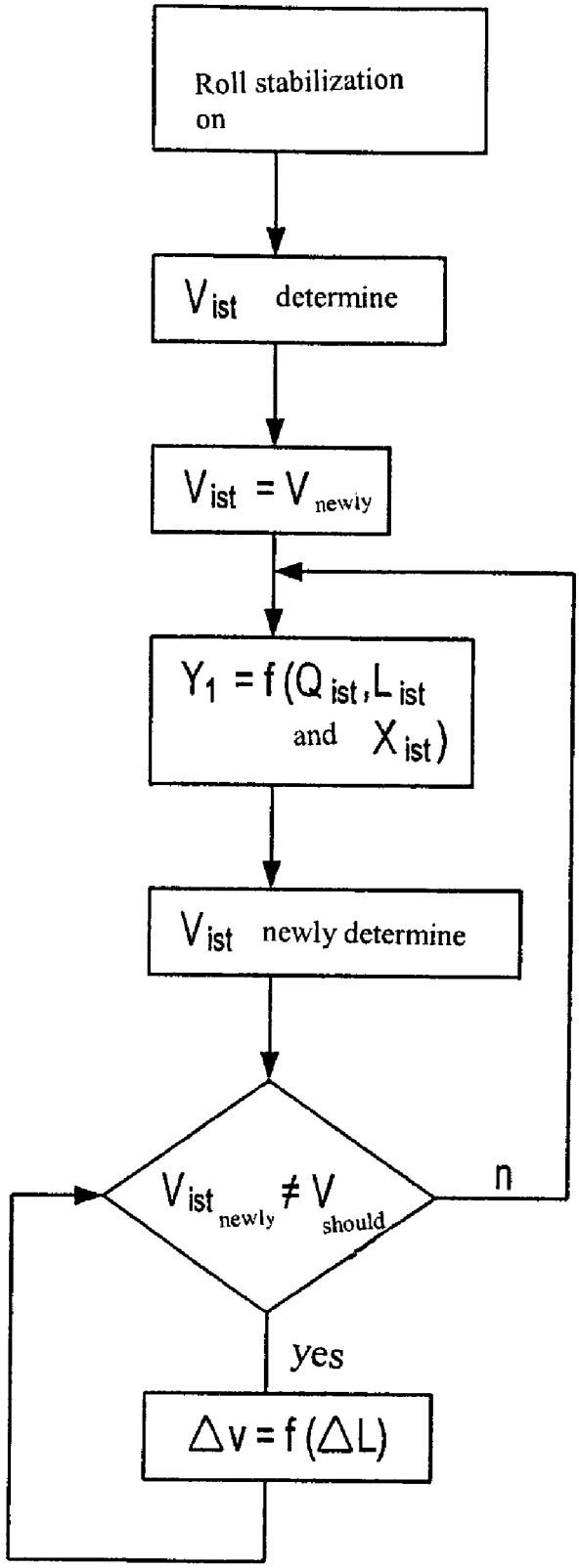

The solution of the invention is explained in greater detail in the following with the help of figures. The figures show the following:

FIG. 1 illustrates in schematically greatly simplified representation the application area of the solution of the invention;

FIGS. 2*a* and 2*b* with the help of block diagrams and one diagram illustrate a first embodiment of the solution of the invention;

FIGS. 3*a* and 3*b* with the help a block diagram and one diagram illustrate a further development of in accordance with FIG. 2;

FIG. 4 with the help of a block diagram illustrates in schematically simplified representation of a further development in accordance with a design in FIG. 3.

Figure 5:
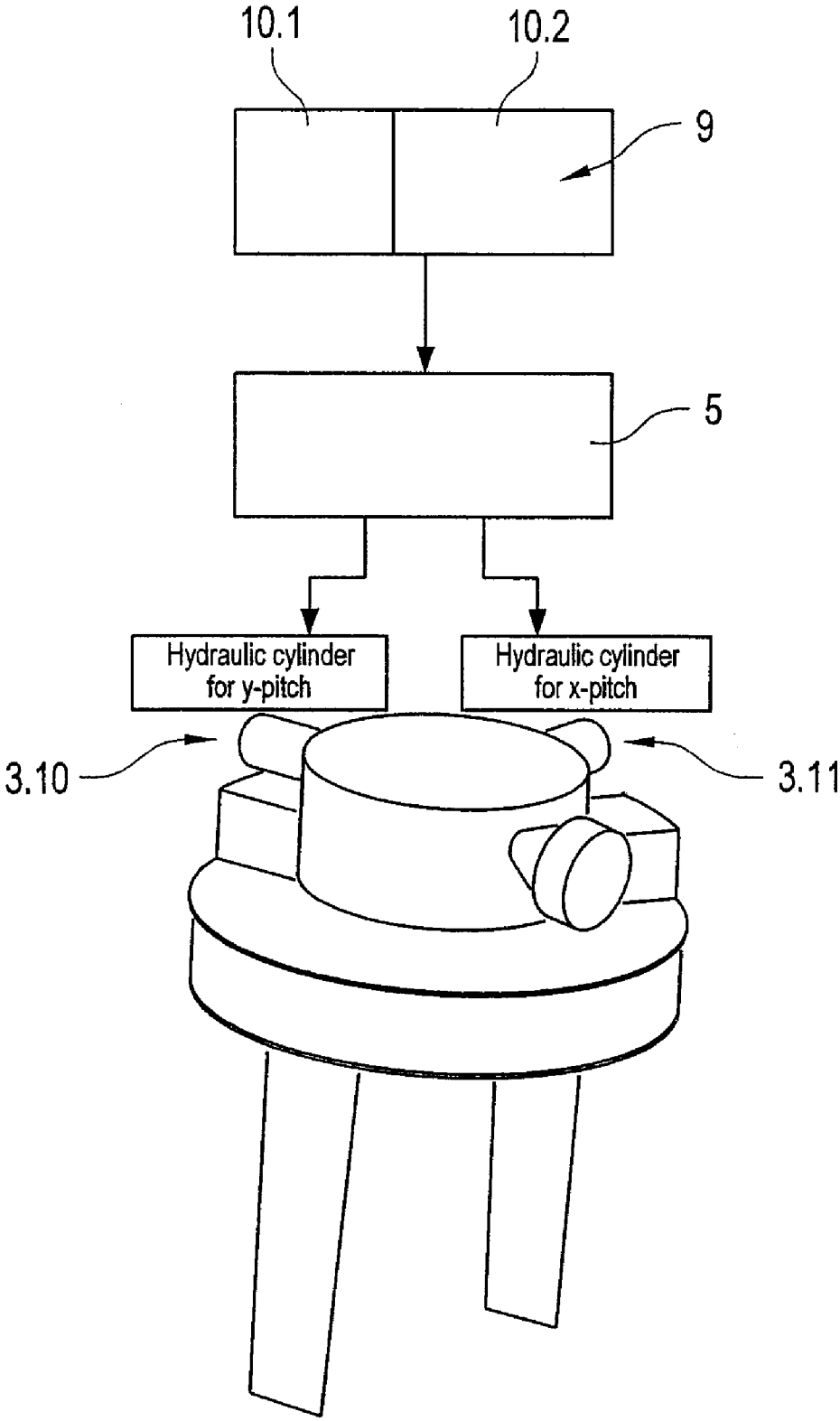

FIG. 5 illustrates one possibility of direct control of the valves of the servomotors.

FIG. 1 illustrates in schematically simplified representation the base structure of a control and regulating system 1 for water vehicles 2, in particular in the form of ships, designed in accordance with the invention, comprising at least one so-called cutter propeller 3. In the case of said propeller it is a matter of a drive element, comprising a rotating wheel body 3.1, which bears axis parallel blades 3.21 to 3.24 on the outer circumference. The blade shafts 3.41 to 3.4n are in the process pivoted in plain bearings or special rolling bearings and sealed from sea water intake and oil seepage by double-action sealing rings.

The wheel body 3.1 is guided in axial direction by a guide plate 3.5 and is centered in radial direction by a roller bearing. While the bearing arrangement transfers the propeller thrust over the propeller housing 3.6 to the ship 2, the guide plate absorbs the dead weight of the rotating parts and the tilting forces and torques resulting from the propeller thrust. The wheel body 3.1 itself is propelled by means of a transmission gear 3.7 flange mounted on the propeller housing 3.6 and a bevel gear arranged in the propeller. The ring gear of the bevel gear is connected to the wheel body 3.1 via the guard plate 3.5 and the driving drum. The control of the kinematics takes place via a control stick which is operated by two servomotors 3.10 and 3.11 offset by 90° as servo components. These two servomotors 3.10 and 3.11 in the process serve the purpose of setting the so-called longitudinal and transverse pitch and hence function as regulating devices 7.1 and 7.2 for setting the longitudinal and/or transverse pitch. The first servomotor 3.10 adjusts the pitch for the longitudinal thrust, i.e. forward and return travel of the ship 2, the second servomotor 3.11, which is also referred to as a rudder servomotor, serves the purpose of influencing the perpendicular thrust, i.e. movements to port-side and starboard. FIG. 1 in the process illustrates in exemplary fashion the base structure of such a propeller. This propeller will not be covered in greater detail, since it has been sufficiently well-known in the state of the art. What is deciding is only the kinematics and the corresponding servomotors, labeled here as 3.10 and 3.11, which enable an adjustability of the blades 3.21 to 3.24. In the process the servomotor 3.10 acts as a so-called drive servomotor and 3.11 acts as a so-called rudder servomotor. The control during operation can take place in different ways. Essentially three fundamental control variants are distinguished for the control of such systems, said variants characterizing operating modes—the manual activation, so-called autopilot and as a third further possibility Dynamic Positioning. A so-called roll stabilization 8 in the form of the control and or regulating system 1 can be added on to these base operating modes in the case of rolling of the ship 2. In accordance with the invention in the process the roll stabilization can be designed in different ways. According to a first design the roll stabilization is activated in dependency on a quantity at least indirectly characterizing the rolling motion of the ship. The activation can take place in the process as required, i.e. manually or also automatically, wherein said activation is subordinate to the individual speed control systems, manual, autopilot or Dynamic Positioning. For this purpose a control and/or regulating device 5 is provided, in which the control variables $Y_1$, $Y_2$ are determined for the roll stabilization. The input quantity is in the process at least one quantity at least indirectly characterizing the rolling motion of the ship 2, preferably the actual value of the transverse pitch directly (INPUT LONGITUDINAL; INPUT TRANSVERSE). From these depending on strategy, as is described in FIGS. 2 through 4, the control variables, in particular the control variable Y1 for activation of the regulating device 7.2 in the form of the servomotor 3.11 for modification of the transverse pitch are determined and output (SPEED RPM; E-MOTOR RPM).

In accordance with a first embodiment of the solution according to the invention a roll stabilization takes place by predefinition of the transverse pitch. By transverse pitch that pitch is understood which describes the thrust motion in the case of standing ship in transverse direction. This method is in exemplary fashion reproduced with the help of a block diagram in FIG. 2*a*. The roll stabilization is activated in the process in the presence of a quantity A indicating a rolling of the ship or at least indirectly characterizing the activation of the roll stabilization. For this purpose a position of the rudder, i.e. a quantity at least indirectly characterizing the current transverse pitch $Q_{ist}$ is recorded and supplied to the control device 5. Said control device can be the control and/or regulating device of the control and/or regulating system 1. In the process an allocation device 6 is integrated in the control and/or regulating device 5, said allocation device enabling an allocation over the maximum range of the adjustability of the rudder, in particular the modification of the transverse pitch in dependency on the current position of the rudder, i.e. of the current transverse pitch $Q_{ist}$. In the simplest case the corresponding allocation takes place via a predefined or stored family of characteristics from which with the help of the currently determined rudder pitch the possible correcting range $\Delta Y$ is determined and a control variable $Y_1$, can be set in dependence on the quantity X characterizing the rolling motion for achievement of the roll stabilization.

FIG. 2*b* illustrates in the process, applied to the theoretically possible usable transverse pitch command, the correcting range for the roll stabilization. The family of characteristics is characterized by two limiting states, which characterized respectively the maximum range of adjustment in the case of set transverse pitch. The straight line I illustrates in the process the state with regard to the possible adjustment travel of the transverse pitch, i.e. of the rudder in both directions in the case of full speed, i.e. 100 percent in forward thrust direction. The two straight lines II and III in the process limit the possible correcting range in dependency on the individual drive states in forward thrust direction, wherein the straight lines II and III describe the limit state, i.e. the maximum possible adjustability in the case of set transverse pitch. The straight lines IV and V describe said state analogously, however for the opposite adjustment direction, here the second adjustment direction. The range for the roll stabilization becomes apparent from this. This is the greatest in the case of set transverse pitch of zero, i.e. an eccentricity, while this range decreases depending on the pre-set transverse pitch, i.e. present actual value $Q_{ist}$ unequal to zero for the transverse pitch. From this family of characteristics either the desired control variable for activation of the regulating device 7 for modification of the transverse pitch can then be determined or also read. In the simplest case in the process the maximum possible correcting range is exhausted in dependency on the present eccentricity, i.e. of the actual value of the current transverse pitch. Correspondingly the corresponding control variable $Y_1$ is output at the outlet of the control and or regulating device 5 and of the regulating device for the modification of the rudder signal, in particular of the transverse pitch is output at the servomotor 3.11. However, the possibility also exists, in dependency on the quantities characterizing the rolling motion, to calculate or assign a control variable $Y_1$, which leads to a setting of an operating point in the corrected range, i.e. the correcting range is not exhausted and the control variable $Y_1$, is set as a function of the current actual value of the transverse pitch, of an actual value of the quantity characterizing the rolling motion.

If FIGS. 2*a* and 2*b* illustrate a first base design of the solution according to the invention for stabilization, FIGS. 3*a* and 3*b* illustrate a further development in accordance with FIG. 2*a*, in which additionally the longitudinal pitch, i.e. the pitch which the thrust causes in longitudinal direction or in propulsive direction, is considered. Also in the case of said pitch the corresponding input variables in accordance with FIG. 2*a* are considered, wherein here however allocation device 6 in exemplary fashion contains a family of characteristics in accordance with FIG. 3*b*, which restrict the possible roll stabilization range in dependency on the current set drive pitch. This means that as further actual quantity a quantity at least indirectly characterizing the current drive or longitudinal pitch $L_{ist}$ can be added to the control or regulating device, wherein in dependency on said quantity from the allocation device 6 the possible modification range for realization of the roll stabilization can be derived. In particular the family of characteristics is structured similar to FIG. 2*b*, however further characteristics are inserted for the individual longitudinal pitches. These are marked with I through $V_x$, wherein x in this case reproduces the pitch in longitudinal direction in percentage. From this it can be recognized that in the case of drive pitch zero, i.e. at a standstill, the possibility of modifying the transverse pitch is the greatest, while in the case of full speed, i.e. drive pitch 100%, the range of adjustment amounts to nearly zero. In dependency on the actual current dive pitch in this family of characteristics then in consideration of the current transverse pitch the theoretically possible correcting range is set compared to the standstill state (POLAR DIRECTION). For this purpose from the respectively determined operating point a control variable Y is determined and with this the servomotor 3.11 is activated.

In accordance with a further development of the design according to FIGS. 2 and 3 additionally the longitudinal pitch for compensation of the occurring speed losses caused by the modification of the transverse pitch can be made. This means that in accordance with FIG. 4 in dependency on the then set modification of the transverse pitch by activation of the regulating devices 7.1 and 7.2 simultaneously the longitudinal pitch is modified, in particular increased in order to achieve a compensation of the speed losses here. This can take place for example in the form of a regulation for setting of a specified speed, wherein an actual value of the current speed $V_{ist}$ is determined before activation or at the beginning of the activation of the roll stabilization and is set as desired value $V_{soll}$ for the speed to be observed or a speed not to be fallen below of and after or modification of the transverse pitch in accordance with the methods shown in FIGS. 2 and 3 additionally a control variable $Y_{2neu}$ is set for modification of the longitudinal pitch. In the process the control variable $Y_{2neu}$ as a rule serves the purpose of increasing the longitudinal pitch, in order to reduce a higher speed or to reduce the speed loss. Here to first in the presence of a quantity at least indirectly characterizing the use of the roll stabilization at least the current transverse pitch is determined and said pitch is supplied to a control device. Further the current present speed $V_{ist}$ is set as desired quantity for the speed to be observed $V_{soll}$ or for a specified speed which can be selected. In the process according to FIG. 2 or FIG. 3 in dependency on the quantities at least indirectly characterizing the rolling motion and of the desired effect, i.e. of the damping of said motion the corresponding control variable for modification of at least the transverse pitch is formed and the speed ensuing in the process $V_{ist}$ is determined and compared to the desired quantity $V_{soll}$ In the case of deviation then an adjustment is made to the effect that the desired speed $V_{soll}$ is preferably stimulated. This takes place by modification of the longitudinal pitch. For this purpose the longitudinal pitch is determined and also processed in the control and regulating device 5 and a control variable for modification of the longitudinal pitch is formed. The determination of the control variable can in the process take place purely mathematically, via diagrams or tables. Said variable is then output in an outlet of the control and/or regulating device 5 and supplied to the respective regulating device, in particular to the servomotor 3.10 for modification of the pitch in longitudinal direction (CONVERT OPERATION; CYLINDER OPERATION; CON VERT RUDDER; CYLTNDER RUDDER). The roll stabilization, in particular deactivation of the rolling motion, is in the process embedded in a control upon introduction of a constant speed.

The following quantities can be considered as parameters for the presence of a rolling motion, at least one of the following quantities:

Rolling angle, rolling angle speed, rolling angle acceleration and/or the quantities describing the waves triggering the rolling motion, like frequency, amplitude.

If at least in designs in FIGS. 1 through 4 the determination of the control variable for activations of the individual regulating devices takes place via further methods, in accordance with FIG. 5 in the case of desired roll stabilization the direct activation of the individual servomotors 3.10 and 3.11 takes place. In this case a recording device 9 recording at least one quantity at least indirectly characterizing the rolling motion is provided, said recording device supplying this quantity to a control and/or regulating device 5, wherein in dependency on the present control signal for longitudinal and/or transverse pitch the adjustment angle is determined directly therefrom. The recording device comprises for this purpose at least two sensors 10.1, 10.2 for the transverse acceleration, wherein said recording device determines the pitch from the difference and from the pitch in turn the control variable Y for activation of the individual servomotors 3.10, 3.11, in particular of the valve devices.

The functions of the various blocks in FIG. 1 are as follows:

DIAGRAM RUDDER, DIAGRAM OPERATION: Corresponds to the pre-definable or pre-defined family of characteristics with reference to FIGS. 2*a* and 3*b*.

INPUT LONGITUDINAL, INPUT TRANSVERSE: A preset transverse pitch in at least one quantity characterizing the rolling motion of the ship.

DIAGRAM OPERATION: Corresponds to the change of the transverse pitch.

POLAR AMPLITUDE: Corresponds to the strength of the rolling motion measured in polar coordinates.

COMBINATOR AMPLITUDE: Determines the required pitch.

CONVERT OPERATION, CYLINDER OPERATION: Converts the required pitch into a correcting variable for activation of the regulation device 7.1, servomotor 3.10, which operates the cylinder of the regulating/valve device.

CONVERT RUDDER, CYLINDER RUDDER: For activation of the individual servomotors, in particular of the valve devices.

MODE REDUCTION LIMITING: Compensates the speed reduction in longitudinal direction on the basis of the pitch of the transverse direction.

COMBINATOR RPM: Changes the RPM of the drive servomotor.

MANUAL MODE: Manual pre-selection of the drive signal.

POLAR DIRECTION: Corresponds to each half (−180° to +180°) of the whole range of values of a polar coordinate system, which is a two-dimensional coordinate system at which each point on a plane is determined by an angle and a distance; the theoretically possible correcting range is set and compared.

SPEED RPM, E-MOTOR RPM: Activation of the regulating device 7.2 for modification of the transverse pitch.

RPM SELECT: Selection of the RPM which operates the cylinder of the regulating/valve device as input at the beginning of the roll stabilization.

COMBINATOR: Primitive functions from which free variables are absent.

LOAD: Corresponds to the initial conditions of the combinator.

| Reference List | |
|---|---|
| 1 | Control and/or regulating system |
| 2 | Water vehicle |
| 3 | Cutter propeller |
| 3.1 | Wheel body |
| 3.2-3.24 | Axis parallel blades |
| 3.41-3.4n | Blade shafts |
| 3.5 | Guide plate |
| 3.6 | Propeller housing |
| 3.7 | Transmission gear |
| 3.10, 3.11 | Servomotor |
| 5 | Control and/or regulating device |
| 6 | Allocation device |
| 7 | Regulating device |
| 8 | Roll stabilization |
| 9 | Reception device |
| 10.1, 10.2 | Sensors |

We claim:

1. A method for roll stabilization of a ship having at least one propeller comprising a rotating wheel body supporting a plurality of circumferentially arranged blades having parallel longitudinal axes and pivotable about their respective longitudinal axes, said method comprising:

inputting a roll quantity at least indirectly characterizing the rolling motion of the ship or a signal for activation of the roll stabilization;

determining the value of a current transverse pitch set on the propeller blades; and modifying the transverse pitch of the propeller blades in dependence on both the current transverse pitch of the blades and the inputted quantity characterizing the rolling motion of the ship to thereby generate a lateral counterthrust to damp the rolling motion of the ship.

2. The method according to claim 1, wherein the transverse pitch is reduced.

3. The method according to claim 2, wherein the step of modifying the transverse pitch is derived from a predefined or prestorable family of characteristics which is limited by two limit lines, wherein the limit lines describe the maximum possible adjustability in the case of a specified default value of the transverse pitch and wherein for each set value of the transverse pitch in the family of characteristics a correcting range between minimum and maximum adjustability results.

4. The method according to claim 1 wherein the step of modifying the transverse pitch is derived from a predefined or prestorable family of characteristics which is limited by two limit lines, wherein the limit lines describe the maximum possible adjustability in the case of a specified default value of the transverse pitch and wherein for each set value of the transverse pitch in the family of characteristics a correcting range between minimum and maximum adjustability results.

5. The method according to claim 4, wherein the value of a control variable ($Y_1$) for modification of the transverse pitch as a function of at least one quantity at least indirectly characterizing the rolling motion of the ship is determined.

6. The method according to claim 5, wherein at least one of the following named roll quantities is input as the quantity at least indirectly characterizing the rolling motion of the ship:

a quantity at least indirectly characterizing the rolling angle a quantity at least indirectly characterizing the rolling speed rolling acceleration a quantity at least indirectly characterizing the swell including amplitude and/or frequency.

7. The method of claim 6, including:

determining an actual value of a current drive pitch set on the propeller blades and relating to forward thrust in a propulsive direction; and limiting the amount of transverse pitch modification that is possible dependent on the set drive pitch.

8. The method of claim 5, including:

determining an actual value of a current drive pitch set on the propeller blades and relating to forward thrust in a propulsive direction; and limiting the amount of transverse pitch modification that is possible dependent on the set drive pitch.

9. The method according to claim 5, wherein speed reduction caused by generation of a transverse thrust is compensated by modification of a longitudinal pitch of the propeller blades and with it modification of a drive pitch in propulsive direction.

10. The method of claim 4, including:

determining an actual value of a current drive pitch set on the propeller blades and relating to forward thrust in a propulsive direction; and limiting the amount of transverse pitch modification that is possible dependent on the set drive pitch.

11. The method according to claim 4, wherein speed reduction caused by generation of a transverse thrust is compensated by modification of a longitudinal pitch of the propeller blades and with it modification of a drive pitch in propulsive direction.

12. The method of claim 1, including:

determining an actual value of a current drive pitch set on the propeller blades and relating to forward thrust in a propulsive direction; and limiting the amount of transverse pitch modification that is possible dependent on the set drive pitch.

13. The method of claim 12, wherein a control variable activates a regulating device to modify the transverse pitch in dependence on the roll quantity, the current transverse pitch set on the blades and the current drive pitch set on the blades.

14. The method according to claim 12, wherein speed reduction caused by generation of a transverse thrust is compensated by modification of a longitudinal pitch of the propeller blades and with it modification of a drive pitch in propulsive direction.

15. The method according to claim 1, wherein speed reduction caused by generation of a transverse thrust is compensated by modification of a longitudinal pitch of the propeller blades and with it by modification of a drive pitch in propulsive direction.

16. The method according to claim 15, wherein a current driving speed of the ship in propulsive direction is determined and an actual value is set as a desired value for a driving speed to be kept constant or a driving speed to be kept constant is predefined as such and in which, in the case of modification of the transverse pitch of the blade, the current driving speed is determined and compared with the set desired value, wherein in the case of deviation a modification of the drive pitch of the blades takes place in such manner that the actual speed value is brought near to the desired value.

17. The method according to claim 1, wherein said method is subordinate to a method for steering a ship.

18. The method according to claim 17, wherein said method is subordinate to any one of the following named methods:

manual setting of a longitudinal pitch automatic setting or regulation of a ship course to be kept constant automatic setting or regulation of a ship position to be kept constant.

19. The method according to claim 1, wherein said method is a component of regulating constant speed.

* * * * *